US009694875B2

(12) United States Patent
Excoffon

(10) Patent No.: US 9,694,875 B2
(45) Date of Patent: Jul. 4, 2017

(54) INFLATABLE HULL AND BUOYANT VEHICLE, IN PARTICULAR A DINGHY

(71) Applicant: SAS Tiwal, Vannes (FR)

(72) Inventor: Marion Excoffon, Baden (FR)

(73) Assignee: SAS Tiwal (FR)

( * ) Notice: Subject to any disclaimer, the term of this patent is extended or adjusted under 35 U.S.C. 154(b) by 133 days.

(21) Appl. No.: 14/353,252

(22) PCT Filed: Oct. 19, 2012

(86) PCT No.: PCT/FR2012/000426
§ 371 (c)(1),
(2) Date: Apr. 21, 2014

(87) PCT Pub. No.: WO2013/057395
PCT Pub. Date: Apr. 25, 2013

(65) Prior Publication Data

US 2014/0251195 A1 Sep. 11, 2014

(30) Foreign Application Priority Data

Oct. 21, 2011 (FR) ..... 11 03231

(51) Int. Cl.
*B63B 7/08* (2006.01)
*B63B 15/02* (2006.01)

(52) U.S. Cl.
CPC ..... *B63B 7/082* (2013.01); *B63B 7/08* (2013.01); *B63B 15/02* (2013.01)

(58) Field of Classification Search
CPC ..... B63B 7/08
See application file for complete search history.

(56) References Cited

U.S. PATENT DOCUMENTS 2,367,835 A * 1/1945 Kreyer ..... B63B 7/08 156/212
3,577,576 A 5/1971 Lobb et al.
(Continued)

FOREIGN PATENT DOCUMENTS

DE 3004416 A1 8/1981
DE 29919234 U1 2/2000
(Continued)

OTHER PUBLICATIONS

International Search Report Application No. PCT/FR2012/000426 Completed: Feb. 28, 2013; Mailing Date: Mar. 7, 2013 2 pages.

*Primary Examiner* — Edwin Swinehart
(74) *Attorney, Agent, or Firm* — St. Onge Steward Johnston & Reens LLC

(57) ABSTRACT

An inflatable hull including at least one air casing that has two walls placed one over the other. The walls each include a fabric sheet, are connected therebetween by a plurality of connecting wires distributed over the entire surface of the sheets while forming a structure suitable for being inflated to a pressure capable of rigidifying the structure, and are capable of ensuring the buoyancy of the hull separately from any reported buoyancy element. The casing has a first transversely cross-sectional curvature and a second longitudinally cross-sectional curvature that is present over at least the front portion of the casing. One of the walls corresponds to the inside of the curvature, and the other of the walls corresponds to the outside of the curvature. The casing has at least one clip set up such as to form a stem.

22 Claims, 11 Drawing Sheets

(56) References Cited

U.S. PATENT DOCUMENTS

| | | | | |
|---|---|---|---|---|
| 3,694,836 | A * | 10/1972 | Serra | B63B 7/082 114/345 |
| 4,149,481 | A | 4/1979 | Leber | |
| 4,750,446 | A | 6/1988 | Sussman | |
| 4,998,494 | A | 3/1991 | Deutsch | |
| 6,131,532 | A | 10/2000 | Winner et al. | |
| 2006/0096517 | A1 * | 5/2006 | Durand | B63B 7/082 114/345 |
| 2009/0031941 | A1 | 2/2009 | Czarnowski et al. | |
| 2009/0078186 | A1 | 3/2009 | Rista | |
| 2011/0036284 | A1 | 2/2011 | Chon | |

FOREIGN PATENT DOCUMENTS

| | | | |
|---|---|---|---|
| FR | 2722758 | A1 | 1/1996 |
| JP | 2007176236 | A | 7/2007 |
| WO | 8606338 | A1 | 11/1986 |

* cited by examiner

INFLATABLE HULL AND BUOYANT VEHICLE, IN PARTICULAR A DINGHY

FIELD OF THE INVENTION

The invention herein concerns an inflatable hull that is particularly—but not exclusively—intended for sail power, and a floating vessel—notably of centerboarder type—incorporating such an inflatable hull.

BACKGROUND OF THE INVENTION

There are, at present, floating vessels that incorporate an inflatable hull and that can be mainly equipped with a rudder, a centerboard well, a centerboard, a mast foundation base, a mast, and a sail. Patents U.S. Pat. No. 3,577,576, DE29919234, U.S. Pat. No. 4,149,481, U.S. Pat. No. 4,750,446, WO8606388 and DE3004416 are testimony to prior state of the art in the domain concerned.

The first disadvantage of these floating vessels that is known is due to the fact that the rigidity of their inflatable hull is lesser than that of a known floating vessel with a hull in a hard material. Consequently, their ability to support the weight of one or more crew members, and their ability to withstand the stresses applied by water and by the mast on the inflatable hull are limited or require the addition of bulky rigid structural reinforcements.

A second disadvantage of these known floating vessels is the shape of the bottom of their inflatable hull, which is flat. Consequently, their inflatable hull has lesser hydrodynamic performances and their behavior under navigation is of lesser quality than that of a known hull that has a bottom of non-flat transversal cross-section—for example, with a U-shaped or V-shaped general form, together with a non-flat longitudinal cross-section and a bow.

A third disadvantage of these known floating vessels is the complexity of assembly of the various pneumatic envelopes of which their inflatable hull is composed. Consequently, the time needed for their production, maintenance and any necessary repairs is long, and this has an unfavorable repercussion on the production costs. In addition, the complexity requires a consequential usage of materials, so these inflatable hulls have a relatively heavy weight. These disadvantages notably also apply to other forms of inflatable hulls covered in the patents JP2007176236, FR2722758 and US2011036284, which have a complex structure incorporating a peripheral buoyancy pudding fender, as well as a deck and transom. Also, the latter are mainly intended for motor propulsion, and do not have good nautical qualities when they are sail-powered because, in addition to being relatively heavy, they do not have a good water contact A fourth disadvantage of these known floating vessels is the lack of structural rigidity of the assembly between the inflatable hull and the equipment of centerboarder type, which does not enable one to use a sail of comparable power to that on a centerboarder constructed in hard material. Consequently, their performance under navigation is lesser than that of known centerboarders constructed with a hull in hard material.

Also known through document US 2009/0031941 is a floating vessel of kayak type of which—in a known manner—the hull incorporates an inflatable bottom and sidewalls or pudding fenders that are also inflatable, and that are integral with each other. According to this document, each of the inflatable envelopes constituting the bottom and the lateral pudding fenders are made of a dual-wall material of which the walls are joined to each other by a multitude of joining threads. Inflation with air is done in the space between the two walls retained by the threads. Such a material offers the advantage of a good rigidity in the inflated state. However, the hull of the vessel according to document US 2009/0031941 has a relatively-complex conventional structure, which is prejudicial, notably from the viewpoint of production cost, weight, ease of use and reliability. Document US 2009/0031941 moreover states that, by choosing the length of the threads that extend between the walls, one can obtain inflatable compartments of any dimensions and form. Supposing that such a dual-wall envelope with joining threads of variable lengths is implementable, it would be a complex way of endowing a desired form on the inflatable compartments. Inflatable floating vessels of deck type with manual propulsion by paddle are also made of such dual-walled materials. The hull has no buoyancy chambers added to the envelope, has a relatively flat bottom, and has a front stem—in other words, a somewhat raised nose. Because of their flat bottom, these deck-type vessels have a nautical behavior that limits them to this board usage.

SUMMARY OF THE INVENTION

The invention has other purposes than proposing an inflatable hull that remedies the above-stated disadvantages, namely an inflatable hull that is rigid during navigation, without requiring a structure, capable of carrying heavy weight and of withstanding big stresses, that can have a bottom of the desired form, and that is simple to manufacture.

For this purpose, the invention addresses an inflatable hull incorporating at least one pneumatic envelope with two superimposed walls, each of which aforesaid walls has a textile layer and is interconnected by a multitude of joining threads distributed over the entire surface of the said layers, forming a structure that is suitable for being inflated to a pressure that can instill rigidity in the said structure, and that ensures the buoyancy of the said hull, independently of any added buoyancy component, with this hull being remarkable in the fact that the said envelope has an initial curvature in the transversal cross-section and a second curvature over at least its front part in the longitudinal cross-section, with one of the said walls being positioned on the interior side of the said curvature, with the other of the said walls being on the exterior side of the said curvature, and with the said envelope having at least one tuck designed to form a bow.

The material with dual textile walls interconnected via joining threads which the envelope incorporates—also called dual-wall textiles—is already known, and has notably been described in an article entitled, "USAGES OF THREE-DIMENSIONAL MATERIALS", having appeared in the publication TEXTILES AND TECHNICAL USAGES, fourth semester 1991, No. 2, pages 25 to 27. Thus, when the inflatable hull is inflated to relatively high pressure, it acquires a rigidity comparable with that of a hull in hard material.

The use of a restricted number of pieces for the manufacturing of the inflatable hull, and the general structure of it is such that the pneumatic envelope plays both the role of a buoyancy chamber, deck and seating. The result is that the inflatable hull is lighter, and that the manufacture, maintenance and repairing of it are greatly facilitated. The tuck constitutes a particularly simple means of producing the bow, in an area in which the hull has both a curvature in the transversal cross-section and a curvature of longitudinal cross-section.

According to another possible characteristic of the invention, the said tuck incorporates a formed fold in the said wall, positioned on the exterior side of the said curvature.

According to another possible characteristic of the invention, the hull includes a junction piece for the said fold.

According to another possible characteristic of the invention, the said tuck is produced by means of cutouts made in at least the front portion of the said inflatable hull, at least in the said wall positioned on the interior side of the said curvature of the envelope, with the aforesaid cutouts being fixed edge-to-edge to form the said bow.

According to another possible characteristic of the invention, the said tuck is produced by means of cutouts made in at least the front section of the said inflatable hull, in each of the said superimposed walls of the said envelope, with the said cutouts being fixed edge-to-edge to form the said bow.

According to another possible characteristic of the invention, the hull includes impermeable junction pieces for the said edge-to-edge fixing of the said cutouts.

According to another possible characteristic of the invention, the said envelope incorporates—over at least a part of its periphery—a lateral peripheral strip with a form establishing the said curvature in the longitudinal cross-section of the said envelope.

Similarly, according to another possible characteristic of the invention, the said peripheral strip incorporates at least one transversal peripheral strip with a form determining the curvature in the transversal cross-section of the said envelope.

Thus manufactured, the inflatable hull according to the invention has good hydrodynamic performances and a high-quality behavior during navigation. The shape endowed upon the lateral strip and the transversal strip, that the dual-wall envelope is constrained to marry its inflated state, constitutes a particularly simple means of endowing respectively the longitudinal cross-section and the transversal cross-section of the hull with the desired non-flat profile.

According to another possible characteristic of the invention, the hull includes at least one impermeable interior strip positioned in a median longitudinal plane between the said walls, to impermeably partition the said pneumatic envelope into an inflatable and deflatable starboard part and port part, that are inflatable and deflatable independently of each other. This is a simple means of producing two independent compartments in the envelope. This way, one conserves a safety buoyancy in the event of an air leak.

According to another possible characteristic of the invention, the hull incorporates at least one impermeable interior strip fixed in a sealed manner between the said walls, to form the lateral wall of at least one aperture at least partially traversing the said inflatable hull.

According to another possible characteristic of the invention, the hull incorporates an initial aperture for passage of a centerboard extending over at least part of the length of the said pneumatic envelope, and traversing the said inflatable hull.

According to another possible characteristic of the invention, the hull incorporates a second, non-traversing aperture, for passage for the mast foundation base, and extending partially through the said inflatable hull.

According to another possible characteristic of the invention, the said wall located on the interior side of the said curvature has a different dimension than the said wall positioned on the exterior side of the said curvature.

Another purpose of the invention is to provide a floating vessel with an inflatable hull that allows the use of a means of propulsion, such as a sail, of a power comparable to such means as might be provided in a vessel in hard material, such as a centerboarder.

For this purpose, the invention also has the purpose of providing a floating vessel incorporating at least one inflatable hull such as described above, equipped with a propulsion device. The rigidity instilled by the inflatable hull according to the invention caters to the aforementioned requirement.

According to another possible characteristic of the invention, the floating vessel includes a piece forming a centerboard well designed to be received in the said first aperture traversing the said hull.

According to another possible characteristic of the invention, the said piece forming a centerboard well has a bend of suitable dimensions to enable insertion of the said piece into the said first aperture traversing the said hull in the deflated state of the said hull, and of retaining the said piece in the said first aperture in the inflated state of the said hull.

According to another possible characteristic of the invention, the floating vessel incorporates a central part incorporating the said part forming a centerboard well and a part forming a mast foundation base.

According to another possible characteristic of the invention, the inflatable hull and the said central part incorporate means for the fixture of at least one bearing part on each side of the inflatable hull, with the said bearing parts being designed to render the said central piece integral with the said inflatable hull, and to distribute the stresses from the mast and the bow onto the inflatable hull. Advantageously, the result of the assembly between the inflatable hull and the equipment parts of the floating vessel is to form an ensemble that is sufficiently structurally rigid to be able to be powered by a sail with a surface area of canvas and a power comparable to that of a centerboarder with a hull in hard material.

According to another possible characteristic of the invention, the said hull includes lateral rings and at least one central ring secured respectively on the opposing sides and in the center of the rear part of the said inflatable hull, with the said vessel including at least one rudder mounting incorporating at least two lateral branches and one lower branch designed to be accommodated respectively in the said lateral and central rings, with the said rudder mounting being shaped to bear upon and be rendered integral with the said inflatable hull in the inflated state.

According to another possible characteristic of the invention, the said vessel includes wings designed to be fixed on each side of the floating vessel, on one of the said branches for the rudder mounting, and on one exterior extremity of the said bearing parts, with the said wings forming—with the said branches and the said bearing parts—a closed structure endowing rigidity on each side of the said hull. This structural ensemble contributes to further rigidifying the hull.

BRIEF DESCRIPTION OF THE DRAWINGS

Other characteristics and advantages of the invention will come to the fore on reading the description that will be presented as preferred forms of implementation of an inflatable hull and a floating vessel according to the invention, the which description is provided as a non-limitative example, making reference to the appended drawings, in which.

DETAILED DESCRIPTION OF THE INVENTION

Figure 1:
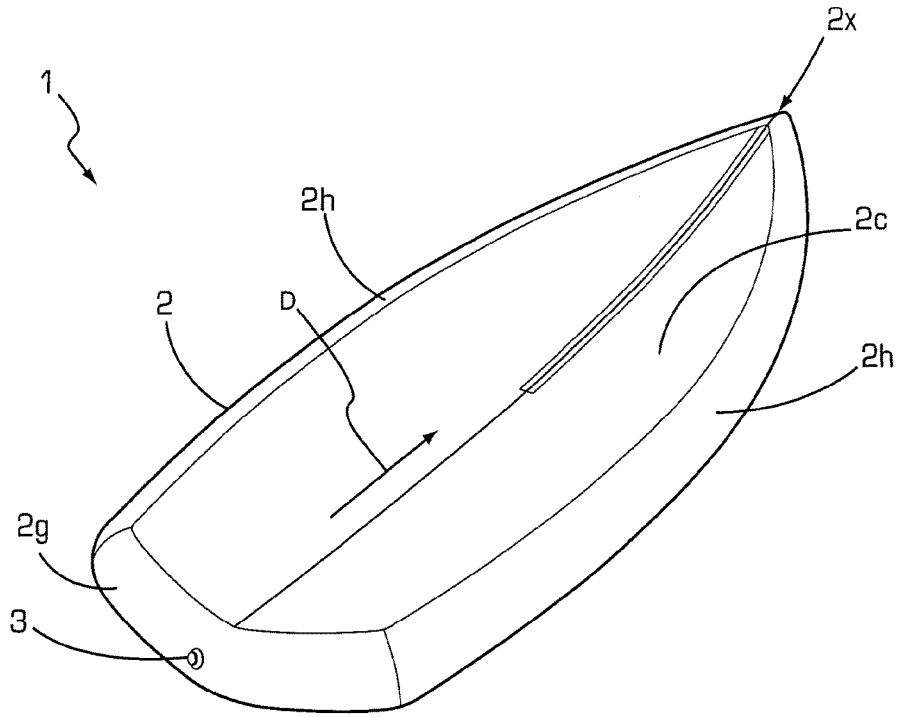
FIG. 1 is a view in perspective of the inflatable hull according to the invention, in the inflated state.

If one refers to FIG. 1, in a preferred form of implementation, the inflatable hull (1) is composed of at least one pneumatic envelope (2) and is advantageously equipped with an inflation and deflation valve (3). The inflatable hull is designed to be rolled or folded. It is light and has very small outside dimensions, which facilitates its storage, handling and transportation.

Figure 2:
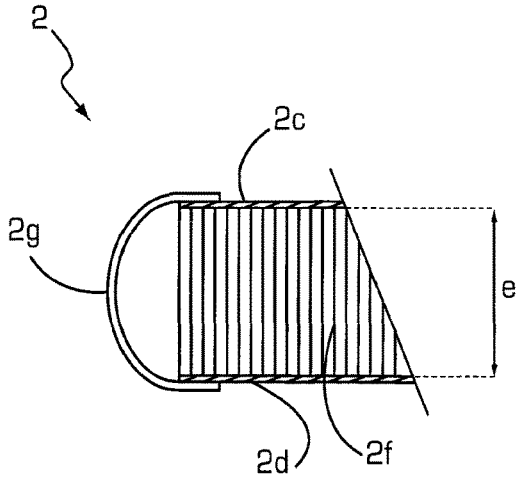
FIG. 2 is a schematic view in partial cross-section of the pneumatic envelope of the inflatable hull, showing the structure of the dual-wall textile.

In use, the inflatable hull (1) withstands the forces applied by water on its submersed parts, the stresses applied by the propulsion system fixed on the inflatable hull (1), and the weight of one or more people. It is therefore essential that the inflatable hull (1) be rigid during navigation. To achieve this end, the pneumatic envelope (2) of the inflatable hull (1) is made of dual-wall textile, as can be more clearly seen in FIG. 2. Dual-wall textiles are known, moreover, and their production process will not be described herein. If one refers to FIG. 2, the dual-wall textile takes the form of two walls, namely an upper wall (2*c*) that constitutes the interior wall of the hull, and one lower wall (2*d*) that constitutes the exterior wall of the hull. These two walls, (2*c*) and (2*d*), respectively consist of two textile layers, and are interconnected by a multitude of joining threads (2*f*). The impermeability of the pneumatic envelope (2) is provided around the edge of the dual-wall textile (2*c*, 2*d*, 2*f*), by an impermeable peripheral strip (2*g*, 2*h*) which is fixed by any appropriate means and, preferably by means of neoprene glue over the entire periphery of the two walls, (2*c*) and (2*d*), such as is illustrated more clearly in FIG. 1. The two textile walls (2*c* and 2*d*) are, moreover, rendered impermeable by any appropriate means, and preferably by means of a rendering of neoprene or any other complex.

In a precise example of implementation that is non-limitative, the two walls (2*c* and 2*d*) consist of textile layers of which the threads are polyamide. The joining threads (2*f*) between the walls (2*c*) and (2*d*) are made of polyester. They are regularly distributed over the entire surface of the inflatable hull (1), at a density of around 15 threads per square centimeter. The walls 2*c* and 2*d* are coated with neoprene on their exterior face. The peripheral strip (2*g*, 2*h*) is composed of textile layers of which the threads are made of polyamide, and is rendered with neoprene on its two faces. In a more-general manner, the thickness of the dual-wall textile (2*c*, 2*d*, 2*f*) of the inflatable hull (1) in the inflated state is 200 mm for rigidity and buoyancy reasons. This value is non-limitative, and could be greater or smaller. It is up to an appropriately knowledgeable professional to establish this thickness E as a function of the dimensions of the inflatable hull (1), and as a function of the weights and stresses it will have to withstand. In a precise example of implementation, which is provided for information only, the inflatable hull (1) measures 3,200 mm in length and 1,200 mm at the main beam. To obtain a sufficient rigidity, the inflatable hull (1) is inflated to a pressure of around 500 millibars, or more. The rigidity of the hull is all the greater when the inflation pressure is high. The inflation pressure is limited by the capacity of the material of which the hull is made, and by the ability of the bonded or welded connections to withstand the mechanical stresses generated by the inflation.

Figure 3:
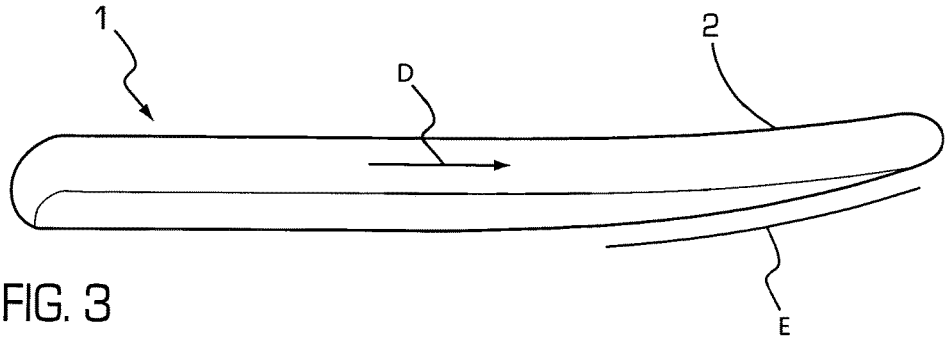
FIG. 3 is a side view of a first variant of the inflatable hull according to the invention, in the inflated state.
Figure 4:
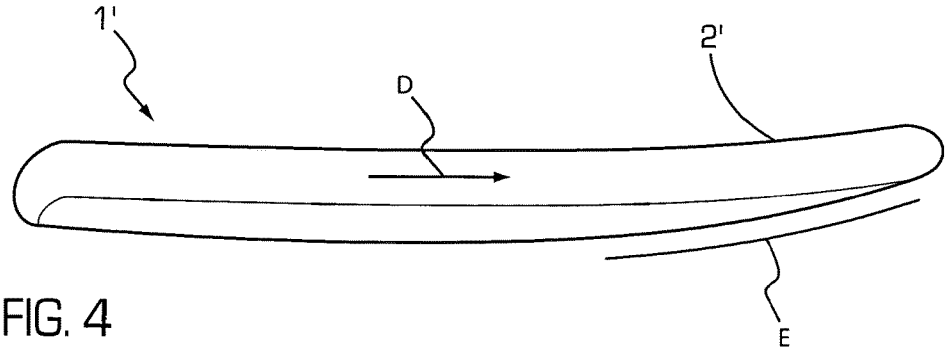
FIG. 4 is a side view of another variant of the inflatable hull according to the invention, in the inflated state.
Figure 5:
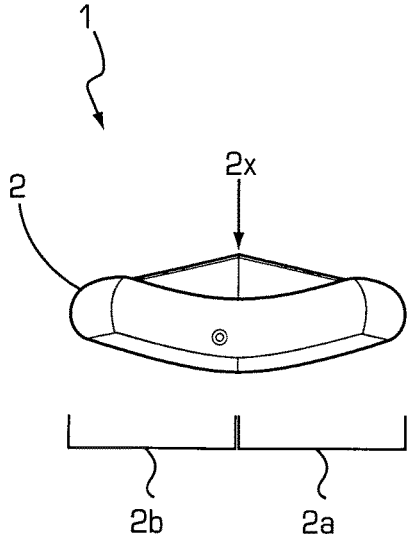
FIG. 5 is a back view of the inflatable hull in the inflated state, in the implementation variant shown in FIG. 3, which has a U-shaped transversal cross-section.
Figure 6:
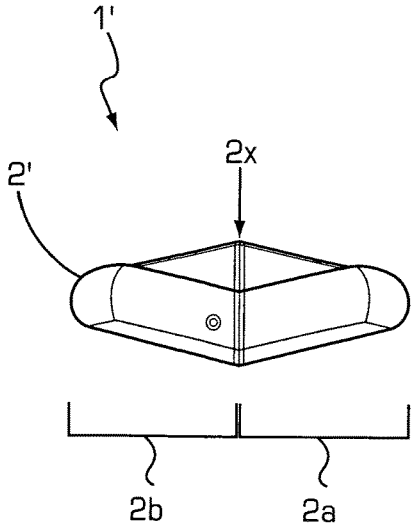
FIG. 6 is a back view of the inflatable hull in the inflated state, in the implementation variant shown in FIG. 4, which has a V-shaped transversal cross-section.

According to one preferred mode of implementation, for hydrodynamic performance reasons, the inflatable hull (1) according to the invention is streamlined towards the front, as shown in FIG. 1, and has a prow or a bow E of curved form in the longitudinal cross-section, as illustrated in FIG. 3, and a non-flat transversal cross-section of generally U-shape, is illustrated in FIG. 5; within the context of this document, the prow or bow is deemed to be the front part of the bottom.

All illustrated in FIGS. 1, 3 and 5, the inflatable hull (1) is composed of a starboard part (2*a*) and a port part (2*b*) bounded on either side by a median longitudinal plane (2*x*) parallel to a longitudinal axis D. The two parts (2*a*) and (2*b*) of the hull are preferably symmetrical in relation to the median plane. (2*x*).

Figure 7:
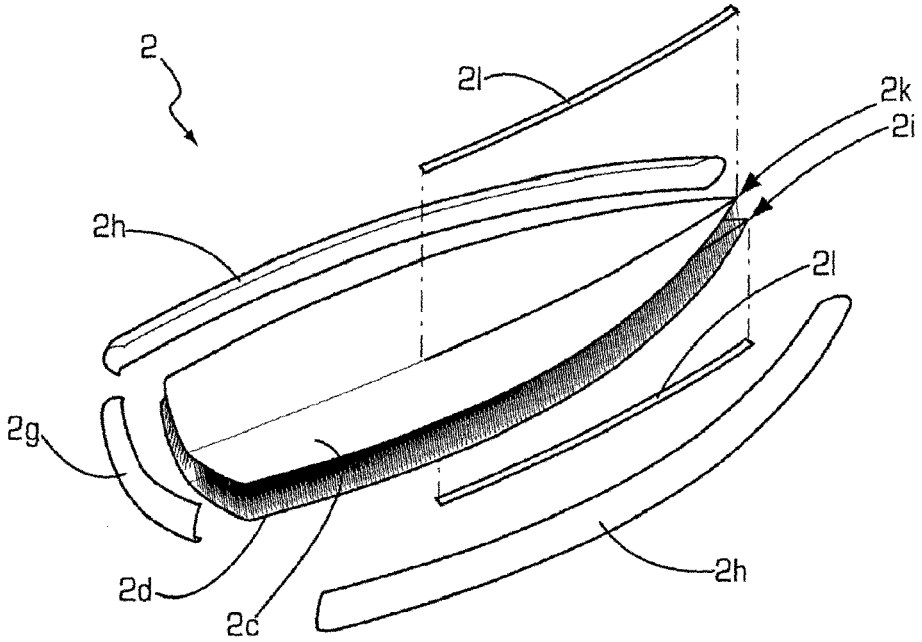
FIG. 7 is a view in perspective of several parts composing the pneumatic envelope of the inflatable hull according to the first variant of implementation presented in FIGS. 3 and 5.
Figure 8:
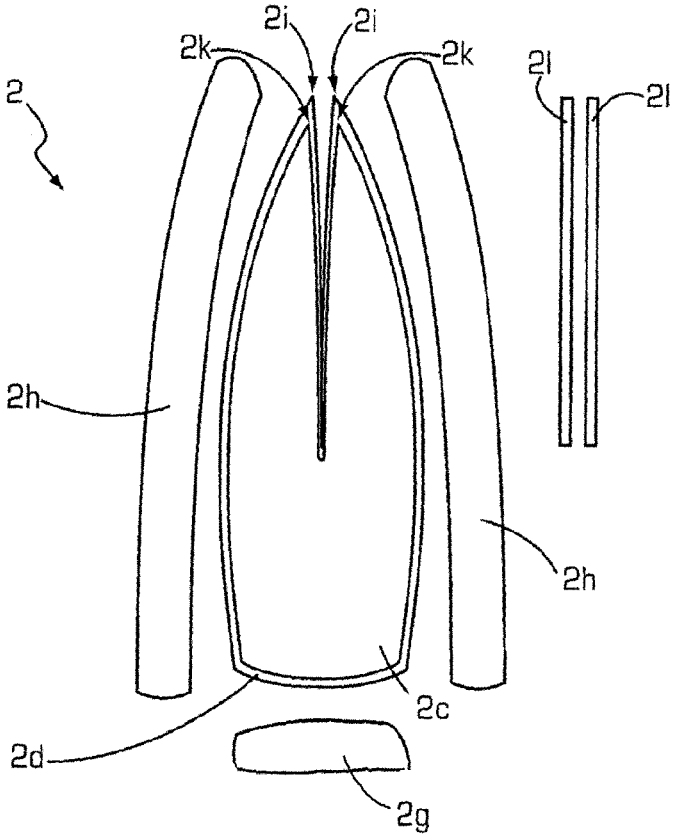
FIG. 8 is an exploded top view showing several parts positioned flat, composing the inflatable hull's pneumatic envelope, as illustrated in FIGS. 3, 5 and 7.

According to one preferred form of implementation in FIGS. 7 and 8, the upper wall (2*c*) and the lower wall (2*d*) of the pneumatic envelope (2) incorporates a tuck that allows one to implement, by means of the dual-wall textile (2*c*, 2*d*, 2*f*) a bow E with a curvature in both the longitudinal and the transversal cross-section. In the context of this document, the term "curvature" means—in this case—a non-flat bottom profile, which can be continuous or non-continuous—for example, a V-shaped or U-shaped form in transversal cross-section.

Thus, the wall (2*c*) has—at the front—a cutout (2*k*) that is essentially a V-shape that is open towards the front, while the wall (2*d*) has—at the front—a cutout (2*i*) that is essentially a V-shape open towards the front. These cutouts are produced in the same manner as when the cutouts (2*l*) are fixed edge-to-edge in the median plane (2*x*), thus procuring a bow E that has curvature in the transversal cross-section and the longitudinal cross-section. Advantageously, the edge-to-edge assembly of the cutout (2*i*) and the cutout (2*k*) is done by means of junction pieces (2*l*) that are—in this particular case—impermeable strips fixed by any appropriate means—and preferably by means of neoprene glue.

As a variant, only the interior wall (2*c*) has, at the front, a cutout (2*k*) that is essentially V-shaped and open towards the front, of which the edges are assembled, for example, by means of a junction piece (2*l*).

Figure 9A:
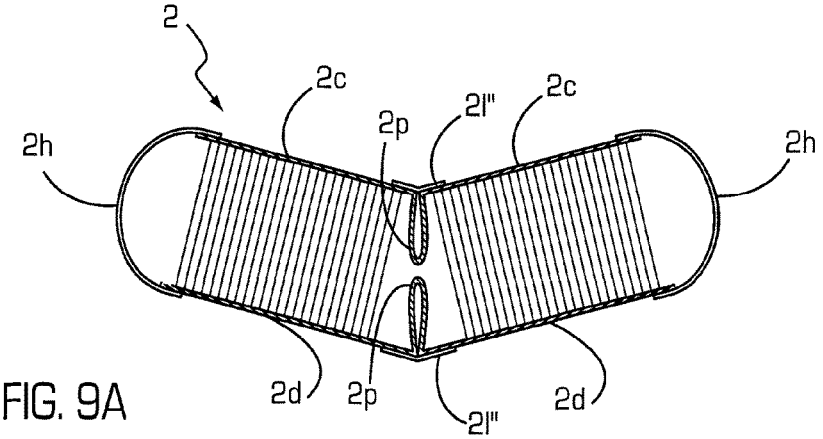
FIG. 9A is a transversal cross-section view of the front of the inflatable hull according to the invention, produced with a longitudinal tuck without cutout.

Of course, according to the invention, it is possible to produce the tuck intended to form the bow without making a cutout for example, by creating a longitudinal fold (2*p*) over a front part of the upper wall (2*c*), and over a front part of the lower wall (2*d*), and by fixing each fold (2*p*) for example, by means of a junction piece (21'), as can be seen more clearly in FIG. 9A.

Figure 9B:
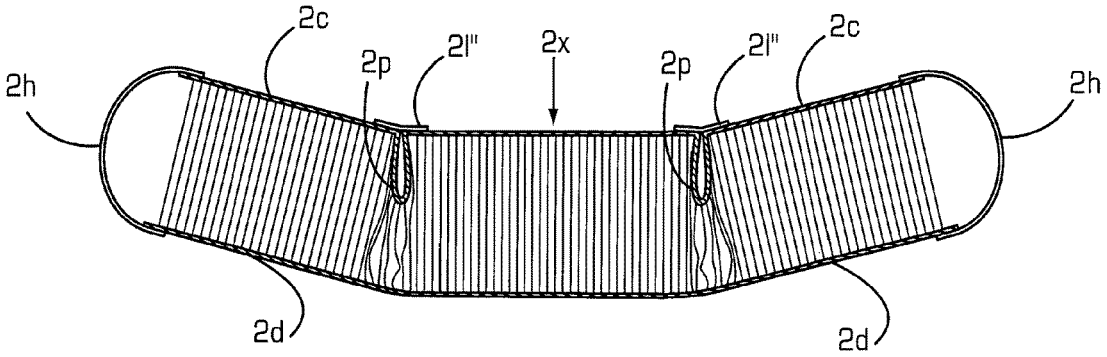
FIG. 9B is a transversal cross-section view of the hull, illustrating a variant of implementation with two longitudinal tucks without cutout.

According to a variant of implementation illustrated in FIG. 9B, the wall (2*c*) has two longitudinal tucks either side of the median longitudinal plane (2*x*), by means of folds (2*p*) that extend over at least a part of the front length of the inflatable hull. Such a design with two longitudinal folds procures a more-pronounced curvature in the transversal cross-section of the dual-wall textile (2*c*, 2*d*, 2*f*) forming the envelope, while avoiding any roll edges forming in the interior wall (2*c*).

Figure 9C:
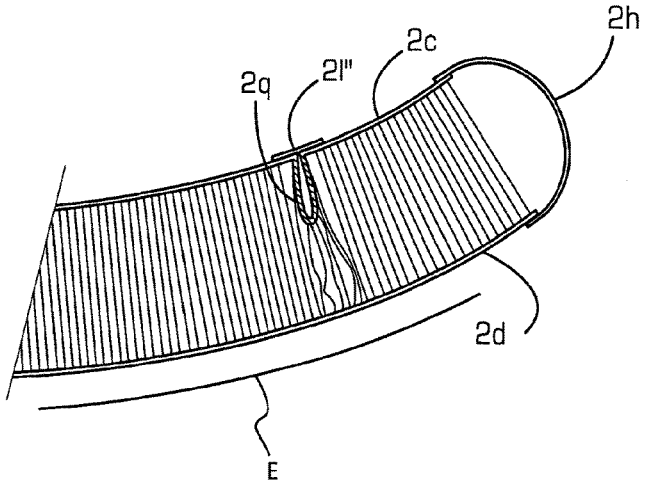
FIG. 9C is a longitudinal cross-section view illustrating another variant of implementation, incorporating a transversal tuck without cutout.
Figure 10:
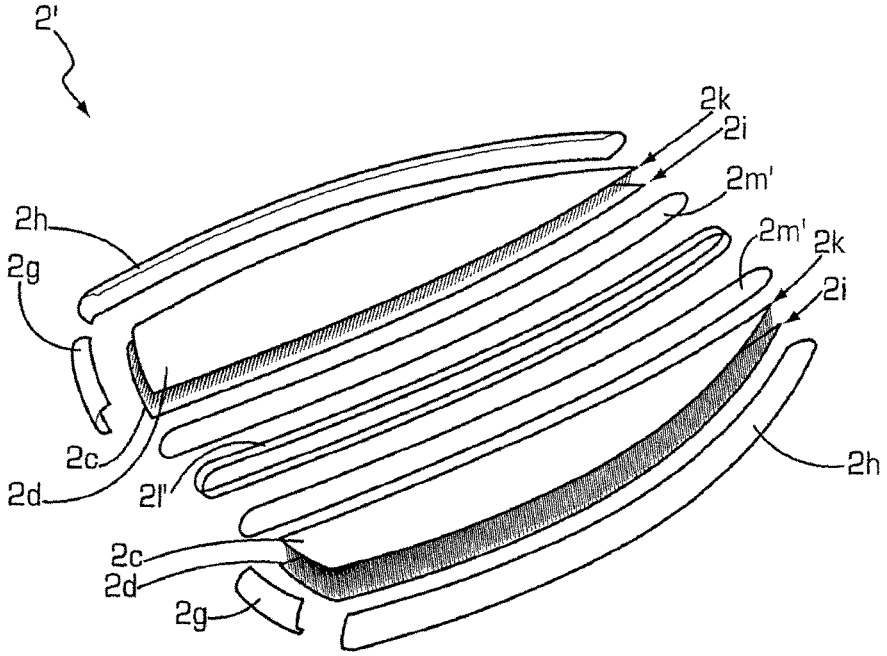
FIG. 10 is an exploded view in perspective of several parts composing the inflatable hull's pneumatic envelope according to the second variant of implementation shown in FIGS. 4 and 6.
Figure 11:
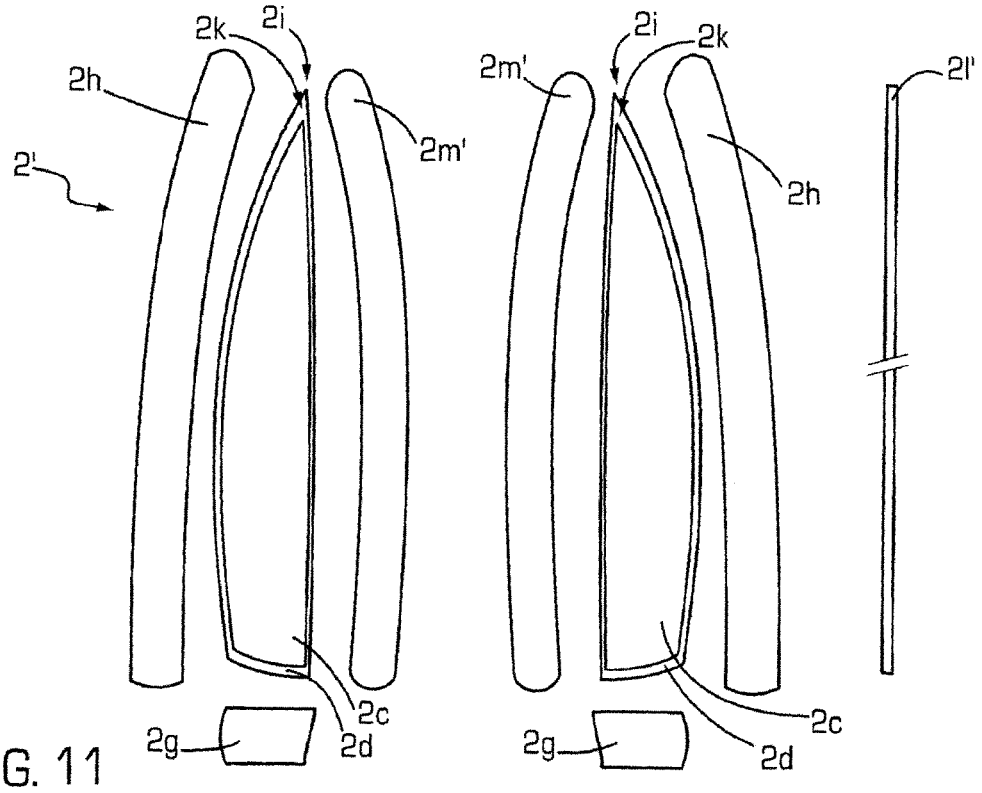
FIG. 11 is an exploded top view showing several parts positioned flat, composing the pneumatic envelope of the inflatable hull illustrated in FIGS. 4, 6 and 10.

According to a variant of implementation illustrated in FIG. 9C, the wall (2*c*) has at least two transversal tucks (2*q*) in, respectively, the port part (2*b*) and the starboard part (2*a*), extending from the lateral edge of the hull. Such a design with two folds procures a more-pronounced curvature in the longitudinal cross-section of the dual-wall textile (2*c*, 2*d*, 2*f*) forming the envelope, while preventing any roll edges forming in the interior wall (2*c*).

According to a preferred form of implementation illustrated in FIGS. 7 and 8, the pneumatic envelope (2) of the inflatable hull (1) has a longitudinal cross-section that is curved at the front. One of the solutions for procuring this curvature in the longitudinal cross-section is to constrain the dual-wall textile (2*c*, 2*d*, 2*f*) by means of the impermeable lateral peripheral strip (2*h*), of which the cutout matches the desired shape of the longitudinal cross-section. During inflation, the starboard lateral peripheral strip (2*h*) establishes the longitudinal cross-section of the port part (2*b*), and the starboard lateral peripheral strip (2*h*) establishes the longitudinal cross-section of the starboard part (2*a*).

In the same manner, the form of the transversal cross-section of the pneumatic envelope (2) of the inflatable hull (1) is established by the form of the transversal peripheral strip (2*g*) located to the rear of the hull, of which the cutout matches the desired form of the transversal cross-section.

Although this is preferable, the pneumatic envelope (2) according to the invention does not necessarily incorporate a tuck, a lateral peripheral strip (2*h*) and a transversal peripheral strip (2*g*), but can—for example—have only one tuck and one lateral peripheral strip (2*h*), and incorporate walls (2*c*) and (2*d*) that are glued together at the transom.

Of course, the method of manufacture of the pneumatic envelope (2) according to the invention enables any desirable shape of the bow E to be endowed, at the front part of the inflatable hull (1), in both the longitudinal cross-section and the transversal cross-section.

It should be noted that, depending on the manufacture, the upper wall (2*c*) of the dual-wall textile (2*c*, 2*d*, 2*f*) of the pneumatic envelope (2), or of any other hull according to the invention, can have a different dimension than the lower wall (2*d*).

For example, according to the variant of implementation in FIGS. 7 and 8, the upper wall (2*c*) located on the interior wall (2*c*) of the hull having this curvature is of smaller dimensions than the lower wall (2*d*) located on the exterior of the curvature in the pneumatic envelope (2), namely the exterior wall (2*d*) of the hull having this curvature. This dimension can vary in the longitudinal direction or the transversal direction, or in both directions. The difference in dimension(s) between the lower wall (2*d*) and the upper wall (2*c*) contributes to procuring the longitudinal and transversal curvature in the dual-wall textile (2*c*, 2*d*, 2*f*).

According to a second variant in implementation illustrated in FIGS. 4, 6, 10 and 11, the inflatable hull (1') according to the invention is manufactured in the same manner as the inflatable hull (1), with the difference lying in the fact that the cutouts (2*i*) and (2*k*) that procure the tuck extend over the entire length of the dual-wall textile (2*c*, 2*d*, 2*f*). Thus, the lateral peripheral strips (2*h*) can establish the form of the longitudinal cross-section over its entire length, and not just at the bow E.

In this particular case, the longitudinal cross-section of the inflatable hull (1') has a continuous curvature, and the transversal cross-section has an essentially V-shaped form. Of course, the method of production of the pneumatic envelope (2') according to the invention enables one to procure any desirable form in the entire longitudinal cross-section and the bow E, and in the transversal cross-section of the pneumatic envelope (2') of the inflatable hull (1').

In order to conserve one or more safety buoyancy chambers in the event of an air leak, the pneumatic envelope (2') is partitioned into two parts, corresponding to the starboard (2*a*) and port (2*b*) parts. Advantageously, the impermeability of each of the starboard (2*a*) and port (2*b*) parts of the inflatable hull's (1') pneumatic envelope (2') is produced by means of two impermeable interior strips (2*m'*) fixed in an impermeable manner by any appropriate means on each of the starboard (2*a*) and port (2*b*) parts—preferably by means of a neoprene glue—such that the starboard (2*a*) part and port (2*b*) part, being each fitted with a valve (3), inflate and deflate independently. Just like the lateral peripheral strips (2*h*), the form of the strips (2*m*') establishes the longitudinal cross-section of the pneumatic envelope (2') of the inflatable hull (1'). The junction piece (2*l*') advantageously extends onto the transom and onto the front of the inflatable hull (1'), so as to assemble the starboard (2*a*) and port (2*b*) parts. Of course, it is possible to construct a partition between the parts (2*a*) and (2*b*) by means of a single strip (2*m*').

Where appropriate, for the same reasons of safety, it is possible to partition the pneumatic envelope (2) and the pneumatic envelope (2') into several independent compartments, notably via internal partition walls.

The inflatable hull (1) and the inflatable hull (1') are usable with any means of propulsion—for example, with a motor, oars, a sail, etc., and more besides, in a non-limitative manner.

Figure 12:
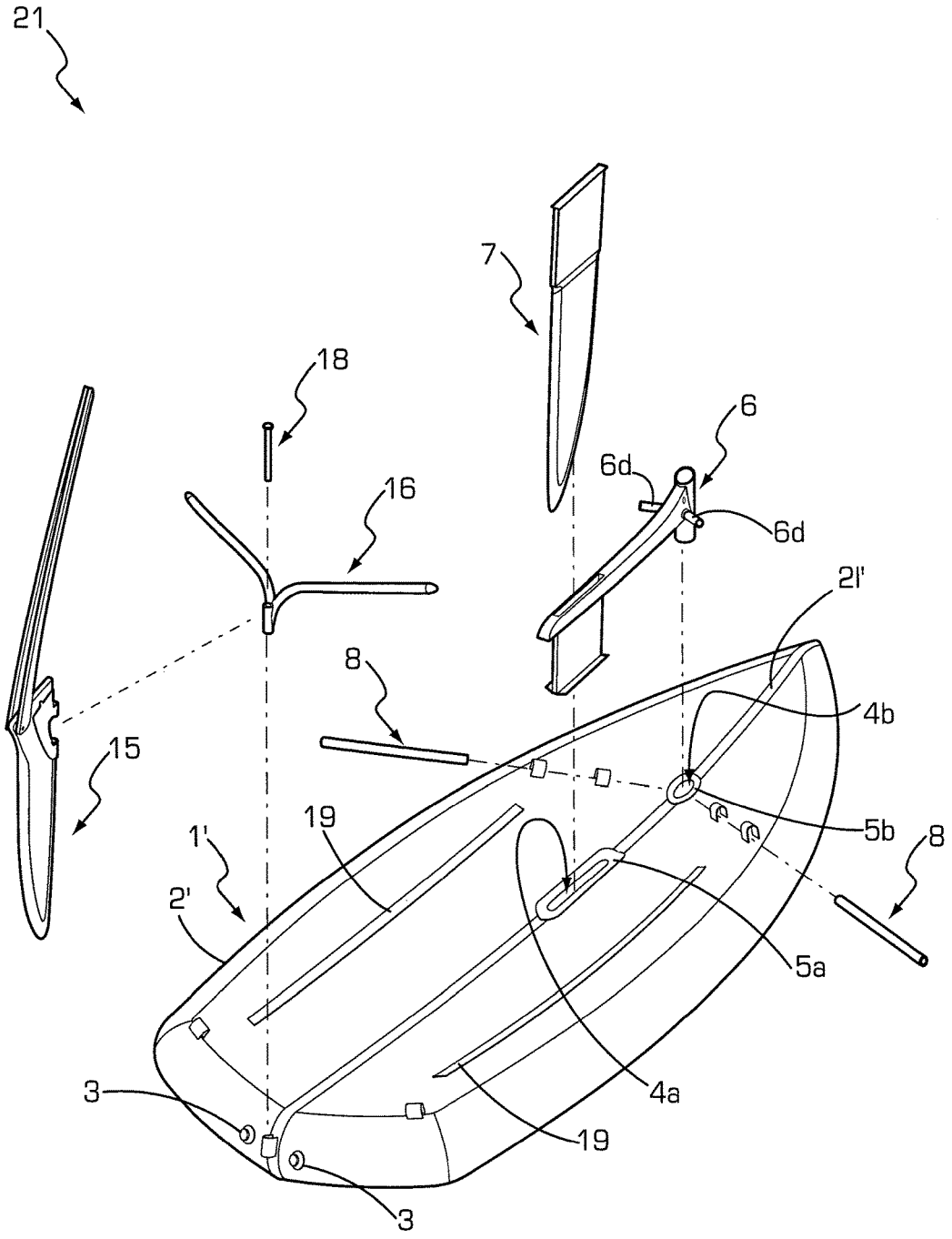
FIG. 12 is a view in perspective of the inflatable hull and a portion of the equipment parts of centerboarder type for a floating vessel powered by sail as according to the invention.
Figure 13:
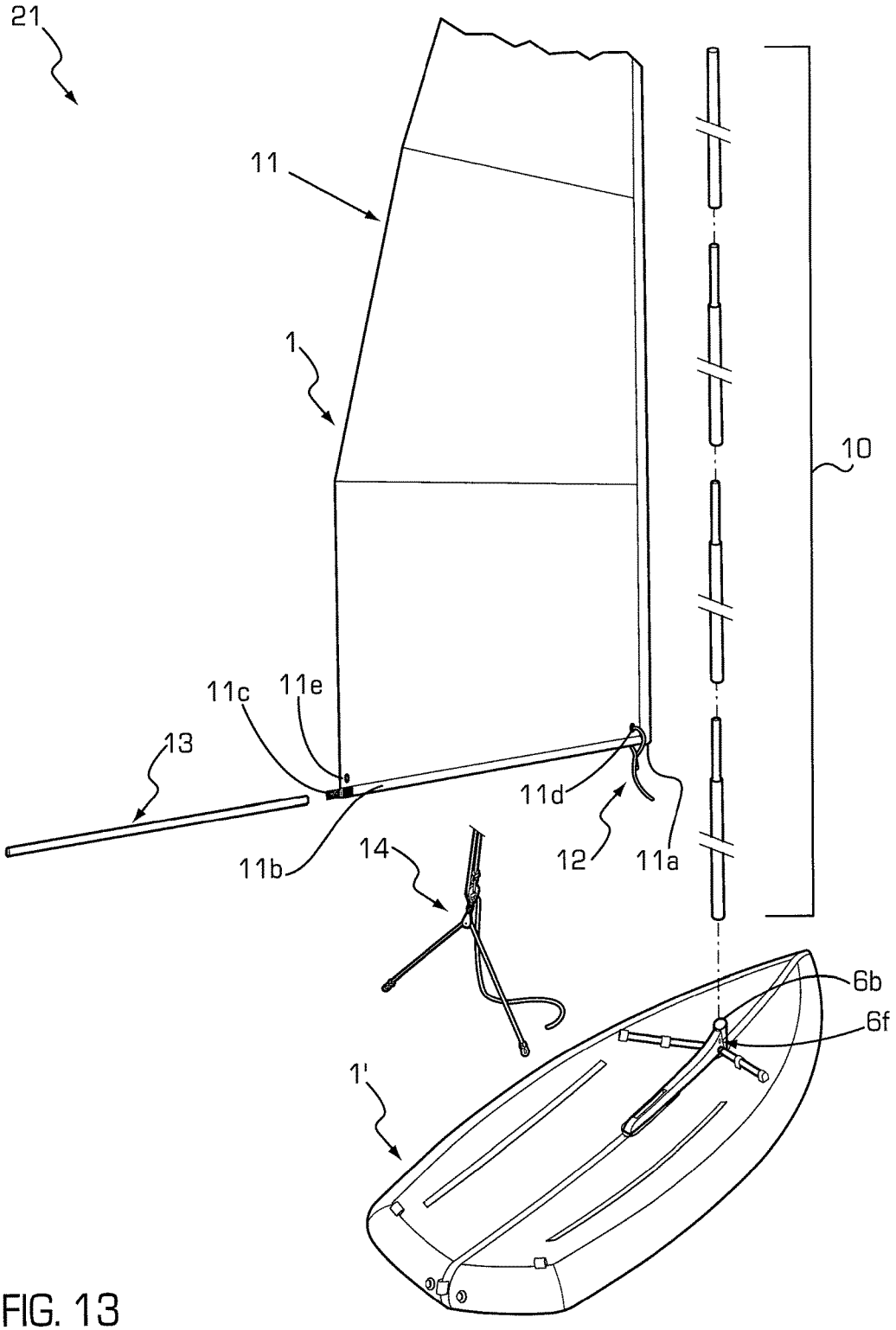
FIG. 13 is a view in perspective of the inflatable hull and a portion of the equipment parts of centerboarder type for a floating vessel powered by sail as according to the invention.

According to one preferred form of implementation of FIGS. 12 and 13, the floating vessel that is referred to overall by the numeric reference (21) incorporates an inflatable hull (1') according to the invention, equipped with various parts of centerboarder type for navigation by sail, namely, a central part (6), a centerboard (7), bearing parts (8), a mast (10), a sail (11), a Cunningham (12), a batten (13), a mainsheet (14), a rudder (15), a rudder mounting (16), and a pin (18).

According to FIG. 12, in a preferred form of implementation, the apertures (4*a*) and (4*b*) located advantageously in the median longitudinal plane (2*x*) traverse the inflatable hull (1') in an essentially vertical manner. The lateral wall of these apertures (4*a*) and (4*b*) are composed of the two impermeable interior strips (2*m*'). The junction piece (2*l*') is cut in a manner so that the aperture (4*a*) has an opening in the upper part and an opening in the lower part, and so that the aperture (4*b*) has a single opening in the upper part, with the mast foundation base not requiring—in this particular case—to traverse the inflatable hull (1') from one side to the other. Advantageously, the openings of the apertures (4*a*) and (4*b*) are consolidated by reinforcements (5*a*) and (5*b*) fixed on their periphery, and implemented by any appropriate means, and notably by means of textile pieces rendered with neoprene, fixed with a neoprene glue.

Figure 14:
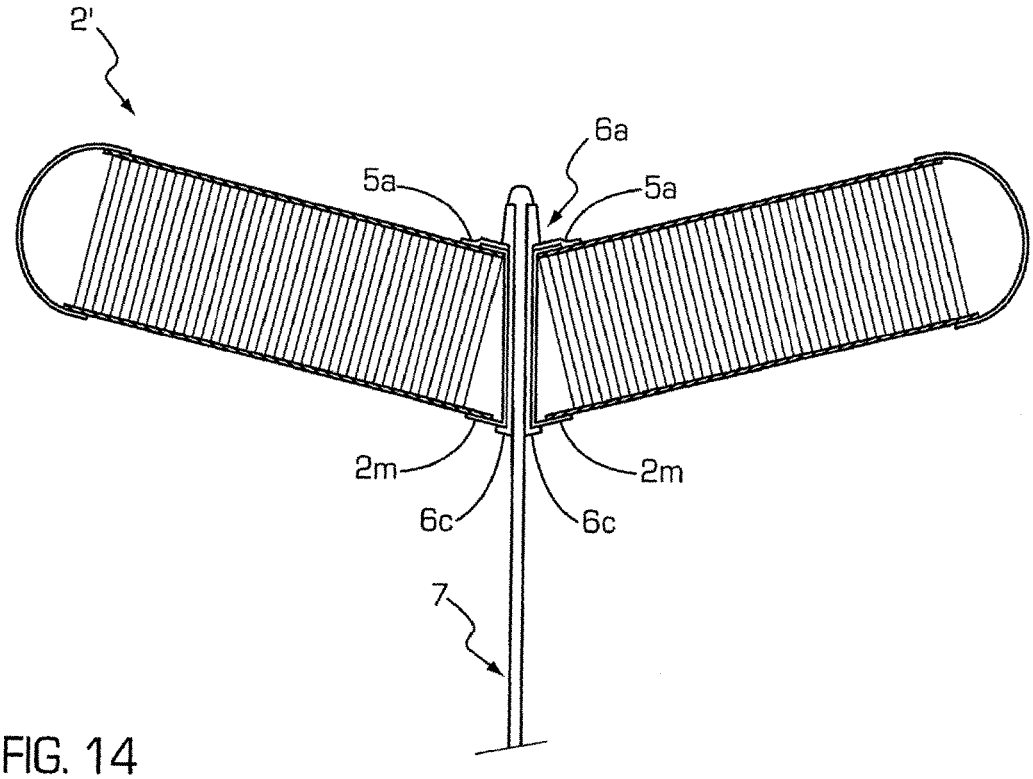
FIG. 14 is a transversal cross-section of an advantageous method for fixing the centerboard well onto the inflatable hull as in FIG. 12.

Advantageously, the aperture (4*a*) has an extended form. In accordance with FIG. 14, the centerboard well (6*a*) which is a rigid chamber of dimensions considerably smaller than the aperture (4*a*) in the horizontal plane, inserts into the aperture (4*a*) of the inflatable hull (1') in the deflated state, and traverses the inflatable hull (1'). The centerboard well (6*a*) has—non-limitatively—two bends or edges (6*c*) in its lower part. When the inflatable hull (1') is inflated to an adequate pressure, the centerboard well (6*a*) is maintained firmly in the longitudinal, transversal and vertical axes, and the bends (6*c*) prevent the extraction of the centerboard well (6*a*) out of the aperture (4*a*). The centerboard well (6*a*) allows one to freely insert or remove the centerboard (7), while preventing it from being pinched by the interior strips (2*m*'). It is up to an appropriately-knowledgeable professional to judiciously establish the location of the centerboard well (6*a*) and, therefore, the aperture (4*a*).

Figure 15:
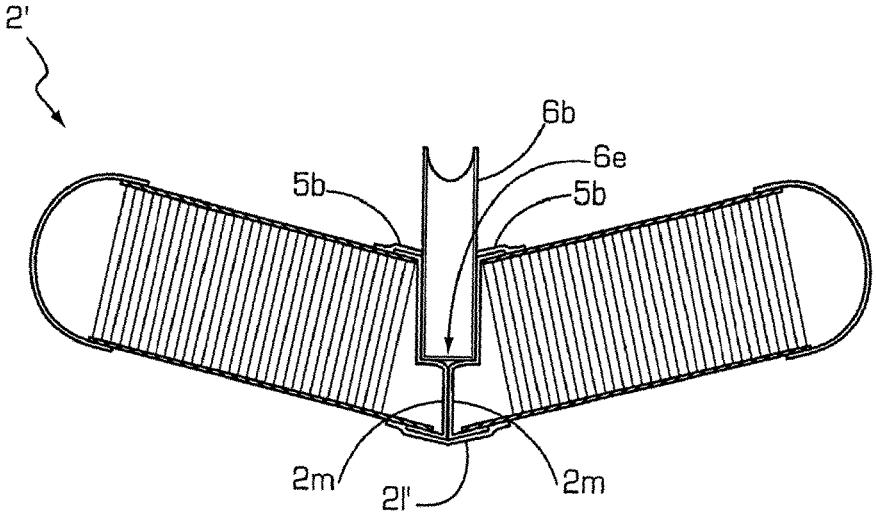
FIG. 15 is a transversal cross-section of an advantageous method of securing the mast foundation base onto the inflatable hull as in FIG. 12.

Advantageously, the aperture (4*b*) is circular. If one refers to FIG. 15, the mast foundation base (6*b*)—which is a rigid tube of a diameter considerably smaller than the aperture (4*b*), is inserted into the aperture (4*b*) of the inflatable hull (1') in the deflated state, and partially traverses the inflatable hull (1'). The mast foundation base (6*b*) is thus maintained firmly in the longitudinal and transversal cross-sections. It is up to an appropriately-knowledgeable professional to judiciously establish the location of the mast foundation base (6*b*) and, therefore, the aperture 4*b*. Within the scope of the invention, although that is preferable, the mast foundation base (6*b*) does not necessarily insert into an aperture of the inflatable hull (1'). Thus, as a variant, the mast foundation base (6*b*) integral with the central part (6) incorporating the centerboard well is simply bearing against the interior wall (2*c*), with the envelope being bereft of the aperture (4*b*).

Figure 16:
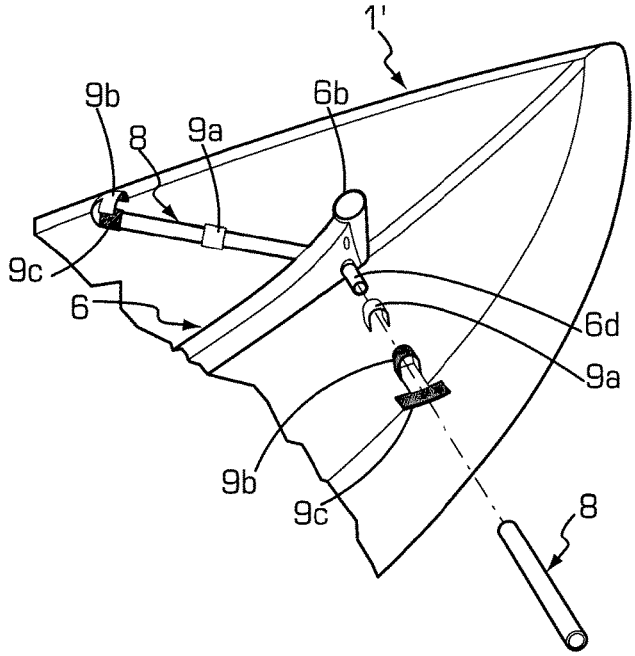
FIG. 16 is a view in perspective of an advantageous method for fixing bearing parts designed to distribute the stresses of the mast and the centerboard on the inflatable hull.

In a preferred form of implementation, the mast foundation base (6*b*) and the centerboard well (6*a*) belong to the same rigid central part (6). This central part (6) bears all the forces exerted by water on the centerboard (7), and by the wind on the sail (11), which itself is borne by the mast (10). In accordance with FIG. 16, two bearing parts (8) optimize the transmission of these forces—which are mainly transversal—by bearing on the inflatable hull (1'), and robustly maintain the front part of the central part (6), and, thus, the mast foundation base (6*b*) against the inflatable hull (1'), preventing the extraction of the mast foundation base (6*b*) from the aperture (4*b*). Advantageously, the two bearing parts (8) are tubes made from a rigid material that insert into rings (9*a*, 9*b*) that are advantageously straps adjusted to the dimension of the bearing parts (8) and fixed by gluing onto the inflatable hull (1'). In a preferred form of implementation, the central part (6) includes sleeves or tenons (6*d*) that are rigid tubes into which the bearing parts (8) insert. Advantageously, the sleeves or tenons (6*d*), which are means of fixing the bearing parts (8) on the central part (6), are located to the front or to the rear on the central part (6). The assembly is maintained in position by means of textile folds (9*c*) fitted with auto-gripping strips. Obviously, the rings (9*a*) and (9*b*) can be flexible, semi-rigid or rigid, and—like the sleeves (6*d*) and the textile folds (9*c*)—can be replaced by any equivalent means of fixation and, notably, by mechanical attachment systems. The bearing parts (8) preferably marry the form of the inflatable hull (1') to provide a large bearing surface. The bearing parts (8) advantageously form an angle towards the rear of the inflatable hull (1') to support, with the central part (6)—the transversal stresses of the mast and the centerboard, and the stresses from the mast towards the rear of the floating vessel (21). Consequently, a sail surface area similar to that of a hard-material centerboarder can be fitted to the floating vessel (21), namely, in this specific example, a non-limitative sail surface area of 5 m2.

Figure 17:
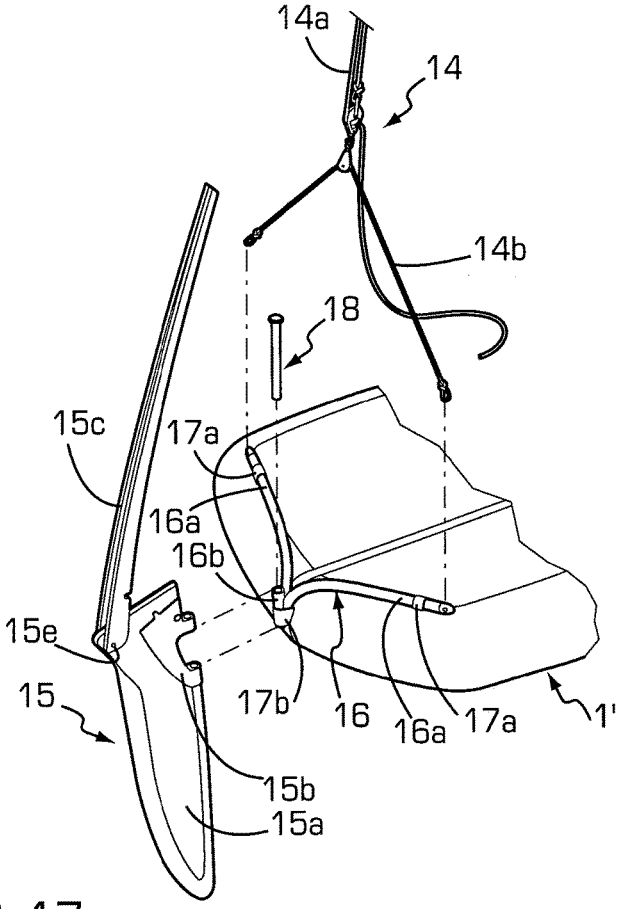
FIG. 17 shows a view in perspective of an advantageous method of securing a rudder mounting, the rudder, and a mainsheet on the inflatable hull.

If one refers to FIG. 17, in a precise example of implementation, the floating vessel (22) is fitted with a rudder mounting (16) composed of tubes formed and assembled so as to marry the shape of the rear of the inflatable hull (1'), with the ensemble having two lateral branches (16*a*) and one lower branch (16*b*). In a preferred implementation, rings (17*a*) are fixed to the left and right of the top part of the transom of the inflatable hull (1'), and a ring (17*b*) is secured to the transom of the inflatable hull (1') in the middle of the vertical plane and the middle of the horizontal plane. Advantageously, these rings (17*a*) and (17*b*) are adjusted respectively to the dimension of the lateral branches (16*a*) and the lower branch (16*b*), and are straps fixed by gluing onto the inflatable hull (1'). The lateral branches (16*a*) are slid into the rings (17*a*) and the lower branch (16*b*) is slid into the ring (17*b*) when the inflatable hull (1') is in the deflated state and, therefore, when it is supple. When the inflatable hull (1') is in the inflated state, its rigidity prevents the extraction of the rudder mounting (16) which, maintained by the rings (17*a*) and (17*b*) bear on the inflatable hull (1') at 3 places at least. Obviously, the rings (17*a*) and (17*b*) could be supple, semi-rigid or rigid, and they could be replaced by any equivalent means of fixation—notably, by mechanical attachment systems. Moreover, the rings (17*a*) and (17*b*) can be fixed anywhere on the transom of the inflatable hull, provided that they are located at a sufficient distance from each other, or provided that there is a sufficient number of them to effectively immobilize the rudder mounting (16) on the inflatable hull (1).

According to a preferred implementation illustrated in FIG. 17, the rudder (15) is fixed onto the rudder mounting (16) by means of the rudder head (15*b*). The rudder head (15*b*) has, in a precise example of implementation, two apertures positioned above and below the lower branch (16*b*) that advantageously fulfill the role of gudgeon. The rudder (15) is maintained in position by a pin (18) that inserts onto the apertures of the rudder head (15*b*) and the lower branch (16*b*) thus positioned.

Mounted above the rudder head (15*a*) is a bar (15*c*) that allows steering of the floating vessel (21). This bar (15*c*) is fixed by a pin (15*e*) to the rudder head (15*a*) and around which it pivots so as to reduce the overall dimensions of the rudder (15) outside navigation.

The mainsheet (14) is composed of a tackle (14*a*) and a moise (14*b*). The ends of the moise (14*b*) are each knotted onto each of the extremities of the branches (16*a*). The upper extremity of the tackle for the mainsheet (14) attaches to an eye (11*e*) illustrated in FIG. 13.

If one refers to FIG. 13, in a precise example of implementation, the mast (10) is composed of 4 pieces that are assembled via a system of sleeves. Once assembled, it is slid into the mast foundation base (11*a*) as one can see for the known rigging of a sailboard. In this precise and non-limitative example, a rigid or semi-rigid batten (13) can be slid into a batten pocket (11*a*) provided on the edge of the sail (11) and locked by means of a strap fitted with an auto-gripping strip (11*c*). The mast (10) is slid into the mast foundation base (6*b*) and bears on the bottom (6*e*) shown in FIG. 15. Advantageously, the Cunningham (12) is passed and fixed into a Cunningham eye (11*d*) and into an aperture (6*f*) provided on the central part (6). It allows adjustment of the tension of the sail (11), and integrates the sail (11) and the mast (10) into the central part (6).

Figure 18:
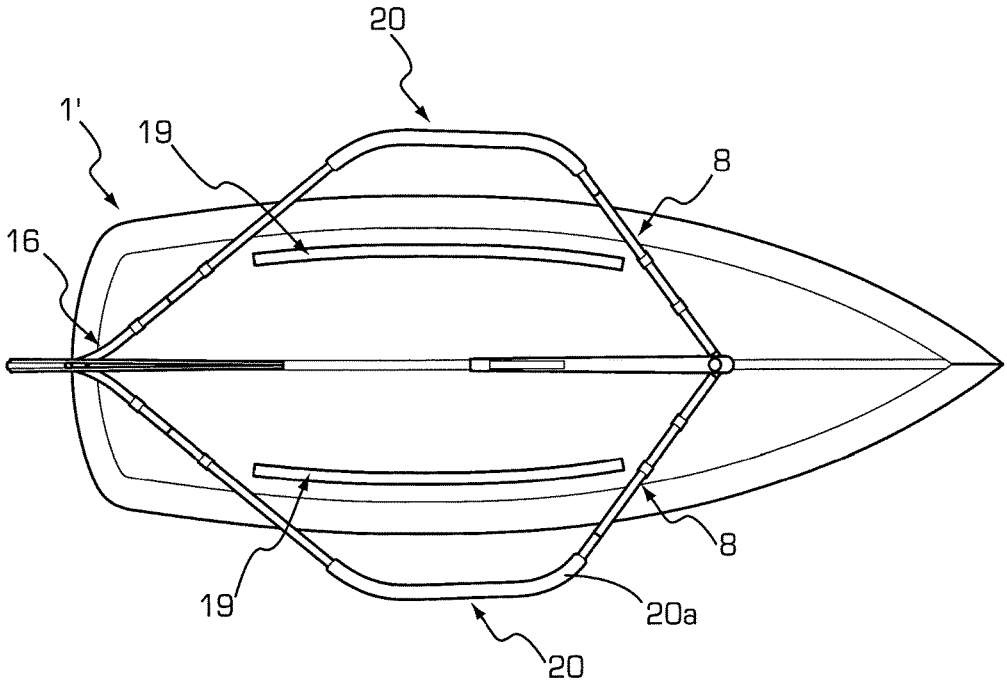
FIG. 18 is a top view of the floating vessel, equipped with wings and return straps.
Figure 19:
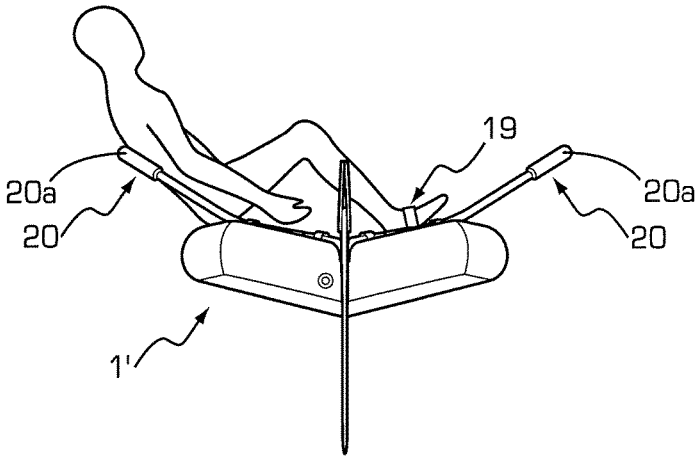
FIG. 19 shows a back view of the floating vessel illustrated in FIG. 18, showing the position of a crew member pressing against the port wing.

In practice, the user(s) is/are seated to starboard or to port of the floating vessel (21) in accordance with its equilibrium. If one refers to FIGS. 18 and 19, two return belts (19) fixed to the inflatable hull (1') enables the user to slide his/her feet under these belts, for leaning towards the back and thus changing the equilibrium of the floating vessel (21) by constituting a counterweight. In accordance with the same logic, it is possible to attach the extremity of the bearing parts (8) to the extremity of the lateral branches (16*a*) of the rudder mounting (16) by the wings (20). In a precise example of implementation, the wings (20) are tubes that can be fixed by a sleeve system to the bearing parts (8) and the lateral branches (16*a*), and which incorporate a foam pudding fender (20*a*). The wings are advantageously located behind the navigator when he/she is seated on the port or starboard edge of the inflatable hull and leans towards the rear. They constitute bearing points for the back or seat, and can possibly stiffen the inflatable hull (1'), notably if the dual-wall textile (2*c*, 2*d*, 2*f*) does not have sufficient thickness to be able itself to withstand the stresses applied to the inflatable hull (1').

According to a preferred form of implementation, a reinforcement arm (8') (not illustrated) extends from the mast foundation base (6*b*) to the extremity of each of the bearing parts (8). The supporting structure for the wings (20), which is intended to support the weight of one or more people, is strengthened.

In practice, when disassembled, the floating vessel (21) is stored in a bag that contains: the inflatable hull (1') and the sail (11) rolled or folded, the equipment parts of centerboarder type, and a manual inflation pump (not illustrated) that fits the inflation and deflation valves (3) of the inflatable hull (1').

To summarize, the assembly of the floating vessel (21) takes place in the following manner. Firstly, the central part (6), then the bearing parts (8) and the rudder mounting (16) are inserted into the inflatable hull (1') in the deflated state. Next, it is possible to fix the wings (20) onto the bearing parts (8) and the rudder mounting. Then the inflatable hull (1') is inflated. Next, one inserts the mast (10) and the batten (13) into the sail (11). The mast (10) is then placed in the mast foundation base (6*b*). The rudder (15) is fixed with the pin (18) and the mainsheet (14) is fitted. Lastly, when the centerboarder is in the water, the centerboard (7) is slid into the centerboard well (6*a*).

Although the floating vessel (21) described incorporates an inflatable hull (1'), it can, of course, incorporate an inflatable hull (1) or any other inflatable hull in accordance with the invention.

Figure 20:
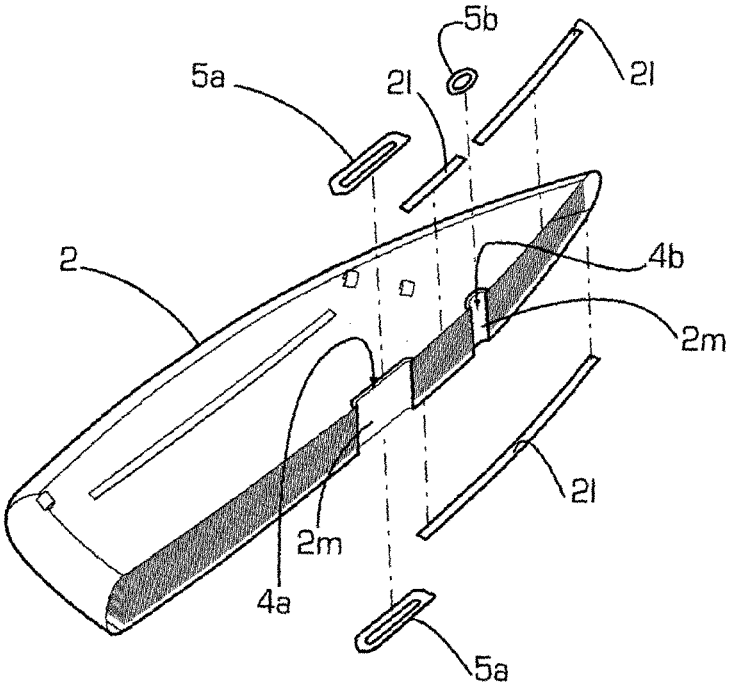
FIG. 20 is a partial view in perspective and in cross-section of the inflatable hull according to the invention, in accordance with the variant of implementation in FIGS. 3, 5, 7 and 8, advantageously equipped with apertures formed by two interior strips.
Figure 21:
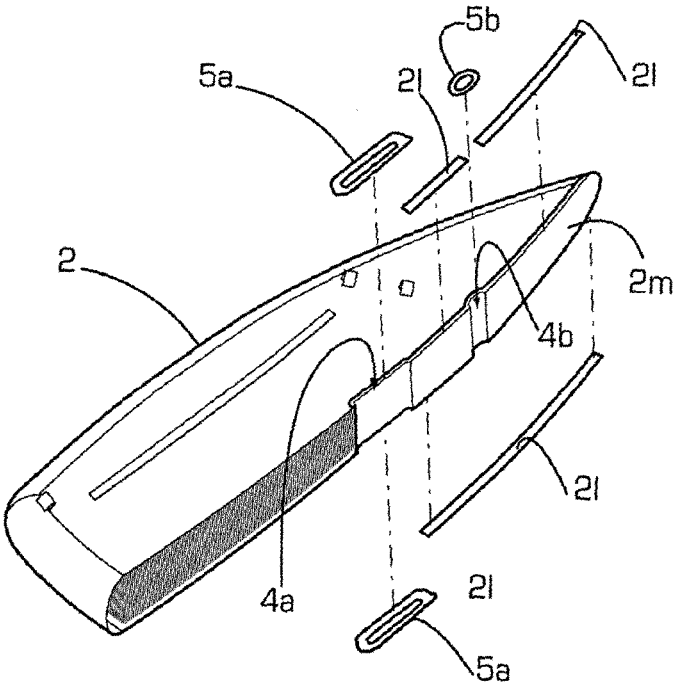
FIG. 21 is a perspective and partial cross-section view of the inflatable hull according to the invention, in accordance with the variant of implementation in FIGS. 3, 5, 7 and 8, advantageously equipped with apertures formed by an interior strip.

Thus, according to another variant of implementation in FIGS. 20 and 21, which is more particularly suited to the inflatable hull (1), one or more interior strips (2*m*) located between the port (2*b*) and starboard (2*a*) parts are fixed impermeably between the two walls (2*c*) and (2*d*) of the dual-wall textile (2*c*, 2*d*, 2*f*) on certain portions of the length of the pneumatic envelope (2), so as to reconstitute the lateral wall of the apertures (4*a*) and (4*b*).

The invention is not limited to the example described with reference to FIGS. 1 to 21, but cover the technical equivalents.

The invention claimed is:

1. A floating vessel comprising at least one inflatable hull incorporating at least one pneumatic envelope with two superimposed walls, wherein said walls each incorporating a layer of textile and being interconnected by a multitude of joining threads spread over the entire surface area of said layers, forming a structure suitable to be inflated to a pressure that can instill rigidity in said structure, and that can ensure a buoyancy of said hull, independently of any added buoyancy component;

wherein said envelope has a first curvature in a transversal cross-section and a second curvature in at least its front part in a longitudinal cross-section forming a bow of the inflatable hull;

wherein one of said walls corresponds with an interior side of said curvature of the bow, and the other of said walls corresponds to an exterior side of said curvature of the bow; and wherein said envelope has at least one tuck worked so as to form the bow;

wherein the floating vessel incorporates a first aperture for passage of a centerboard extending over at least a portion of the length of said pneumatic envelope, and traversing said inflatable hull;

wherein the floating vessel includes at least one part forming a centerboard well designed to be received in said first aperture traversing said hull; and equipped with a propulsion system.

2. The floating vessel according to claim 1, wherein the propulsion system comprises a mast and a sail.

3. The floating vessel according to claim 2, wherein said part forming a centerboard well has a bend of suitable size to allow the insertion of said part into the first traversing aperture in the deflated state of said hull, and hold said part in said first aperture in the inflated state of said hull.

4. The floating vessel according to claim 2, wherein the floating vessel incorporates a central part incorporating said part forming a centerboard well and a part forming a mast foundation base.

5. The floating vessel according to claim 4, wherein said inflatable hull and said central part incorporate at least one bearing part for each side of the inflatable hull, with said bearing parts being designed to integrate said central part with said inflatable hull and distribute the stresses from the mast and the centerboard on the inflatable hull.

6. The floating vessel according to claim 1, wherein said hull includes lateral rings and at least one central ring fixed respectively on the opposing sides and at a center of a rear part of said inflatable hull, with said vessel incorporating at least of rudder mounting incorporating at least two lateral branches and one lower branch designed to be received respectively in said lateral and central rings, with said rudder mounting being formed to bear on and be integral with said inflatable hull in the inflated state.

7. The floating vessel according to claim 5, wherein wings designed to be fixed on each side of the floating vessel on one of said branches of the rudder mounting and on one exterior extremity of said bearing parts, said wings forming, with the branches and said bearing parts, a closed rigidifying structure on each side of said hull.

8. An inflatable hull incorporating at least one pneumatic envelope with two superimposed walls;

wherein said walls each incorporating a layer of textile and being interconnected by a multitude of joining threads spread over the entire surface area of said layers, forming a structure suitable to be inflated to a pressure that can instill rigidity in said structure, and that can ensure a buoyancy of said hull, independently of any added buoyancy component;

wherein said envelope has a first curvature in a transversal cross-section and a second curvature in at least its front part in a longitudinal cross-section forming a bow of the inflatable hull;

wherein one of said walls corresponds with an interior side of said first and second curvature of the bow, and the other of said walls corresponds to an exterior side of said first and second curvature of the bow;

wherein said envelope has at least one tuck worked so as to form the bow;

at least one impermeable interior strip fixed impermeably between said walls to form the lateral wall of at least one aperture traversing—at least partially—said inflatable hull.

9. The inflatable hull according to claim 8, wherein the inflatable hull incorporates a first aperture for passage of a centerboard extending over at least a portion of the length of said pneumatic envelope, and traversing said inflatable hull.

10. The inflatable hull according to claim 8, wherein the inflatable hull includes a second aperture that is not fully penetrating, for passage for a mast foundation base and extending partially through said inflatable hull.

11. The inflatable hull according to claim 8, wherein said tuck incorporates a fold formed in said wall positioned on the interior side of said first and second curvature.

12. The inflatable hull according to claim 8, wherein said tuck incorporates a fold formed in said wall located on the exterior side of said first and second curvature.

13. The inflatable hull according to claim 8, wherein the inflatable hull incorporates a junction piece for said fold.

14. The inflatable hull according to claim 8, wherein said tuck is produced by cutouts made in at least one portion of said inflatable hull, at least in said wall positioned on the interior side of said first and second curvature of said envelope, with said cutouts being fixed edge-to-edge to form said bow.

15. The inflatable hull according to claim 14, wherein said cutouts being made in each of the superimposed walls of said envelope, with said cutouts being fixed edge-to-edge to form said bow.

16. The inflatable hull according to claim 15, wherein the inflatable hull incorporates impermeable joining parts for said edge-to-edge fixation of said cutouts.

17. The inflatable hull according to claim 8, wherein said envelope incorporates, an at least one part of its periphery, a lateral peripheral strip with a form establishing said curvature in the longitudinal cross-section of said envelope.

18. The inflatable hull according to claim 8, wherein said envelope incorporates—over at least part of its periphery—a transversal peripheral strip having a form that establishes said curvature in the transversal cross-section of said envelope.

19. The inflatable hull according to claim 8, wherein the inflatable hull incorporates at least one impermeable interior strip positioned in a median longitudinal plane between said walls to impermeably partition said pneumatic envelope into one starboard part and one port part that are inflatable and deflatable independently of each other.

20. An inflatable hull incorporating at least one pneumatic envelope with two superimposed walls;

wherein said walls each incorporating a layer of textile and being interconnected by a multitude of joining threads spread over the entire surface area of said layers, forming a structure suitable to be inflated to a pressure that can instill rigidity in said structure, and that can ensure a buoyancy of said hull, independently of any added buoyancy component;

wherein said envelope has a first curvature in a transversal cross-section and a second curvature in at least its front part in a longitudinal cross-section;

wherein one of said walls corresponds with an interior side of said first and second curvature, and the other of said walls corresponds to an exterior side of said first and second curvature;

wherein said envelope has at least one tuck worked so as to form a bow; and wherein a first longitudinal fold over a front part of the upper wall, and a second longitudinal fold over a front part of the lower wall, is created and each fold is fixed by a junction piece.

21. An inflatable hull incorporating at least one pneumatic envelope with two superimposed walls;

wherein said walls each incorporating a layer of textile and being interconnected by a multitude of joining threads spread over the entire surface area of said layers, forming a structure suitable to be inflated to a pressure that can instill rigidity in said structure, and that can ensure a buoyancy of said hull, independently of any added buoyancy component;

wherein said envelope has a first curvature in a transversal cross-section and a second curvature in at least its front part in a longitudinal cross-section;

wherein one of said walls corresponds with an interior side of said first and second curvature, and the other of said walls corresponds to an exterior side of said first and second curvature;

wherein said envelope has at least one tuck worked so as to form a bow; and wherein the upper wall has—at the front—a first cutout that is essentially a V-shape that is open towards the front, and the lower wall has—at the front—a second cutout that is essentially a V-shape open towards the front, these cutouts being fixed edge-to-edge in the median plane of the hull by means of impermeable strips fixed by neoprene glue to form the tuck, such that the bow has a curvature in the transversal cross-section and the longitudinal cross-section.

22. An inflatable hull incorporating at least one pneumatic envelope with two superimposed walls, an upper wall forming an interior wall of the hull and a lower wall forming an exterior wall of the hull;

wherein said walls each incorporating a layer of textile and being interconnected by a multitude of joining threads spread over the entire surface area of said layers; and at least one impermeable peripheral lateral strip glued with the upper wall and the lower wall to form a structure suitable to be inflated to a pressure that can instill rigidity in said structure, and that can ensure a buoyancy of said hull, independently of any added buoyancy component;

wherein said envelope has a first curvature in a transversal cross-section and a second curvature in at least its front part in a longitudinal cross-section;

wherein said envelope has at least one tuck worked so as to form a bow; and wherein the upper wall has—at a front—a first cutout that is essentially a V-shape that is open towards the front, while the lower wall has—at the front—a second cutout that is essentially a V-shape open towards the front, these cutouts being fixed edge-to-edge in a median plane of the hull by means of impermeable strips fixed by means of neoprene glue to form the tuck, such that, with the at least impermeable lateral peripheral strip, the bow has a curvature in the transversal cross-section and the longitudinal cross-section.

* * * * *